US007470109B2

(12) United States Patent
Tomko et al.

(10) Patent No.: US 7,470,109 B2
(45) Date of Patent: Dec. 30, 2008

(54) MACHINE TOOLED DIAPHRAGM PARTITIONS AND NOZZLES

(75) Inventors: Andrew John Tomko, Glenville, NY (US); John Francis Nolan, Cobleskill, NY (US)

(73) Assignee: General Electric Co., Schenectady, NY (US)

( * ) Notice: Subject to any disclaimer, the term of this patent is extended or adjusted under 35 U.S.C. 154(b) by 0 days.

(21) Appl. No.: 11/979,430

(22) Filed: Nov. 2, 2007

(65) Prior Publication Data

US 2008/0063519 A1 Mar. 13, 2008

Related U.S. Application Data

(63) Continuation of application No. 11/251,860, filed on Oct. 18, 2005, now Pat. No. 7,329,096.

(51) Int. Cl.
*F01D 9/04* (2006.01)

(52) U.S. Cl. ..... 415/209.4

(58) Field of Classification Search ..... 415/189, 415/190, 209.2, 209.3, 209.4, 210.1; 416/189–191, 416/215–218, 219 R, 220 R
See application file for complete search history.

(56) References Cited

U.S. PATENT DOCUMENTS

| | | | | | |
|---|---|---|---|---|---|
| 1,740,800 | A * | 12/1929 | Wiberg | ..... | 29/889.21 |
| 2,264,877 | A * | 12/1941 | Haigh | ..... | 415/209.4 |
| 3,313,520 | A * | 4/1967 | Ortolano et al. | ..... | 415/209.4 |
| 5,586,864 | A | 12/1996 | Knorowski et al. | | |
| 5,743,711 | A | 4/1998 | Fournier et al. | | |
| 7,329,096 | B2 * | 2/2008 | Tomko et al. | ..... | 415/209.4 |

FOREIGN PATENT DOCUMENTS

| | | | | | |
|---|---|---|---|---|---|
| FR | 717417 | A * | 1/1932 | ..... | 415/209.4 |
| FR | 1183012 | A * | 7/1959 | ..... | 415/209.3 |
| GB | 594204 | A * | 11/1947 | ..... | 415/209.3 |

* cited by examiner

*Primary Examiner*—Christopher Verdier
(74) *Attorney, Agent, or Firm*—Nixon & Vanderhye P.C.

(57) ABSTRACT

Partitions have an airfoil coupled at opposite ends to inner and outer side walls. The side walls each mount radially extending male dovetails. The inner web and outer ring of a diaphragm include complementary shaped dovetail grooves. The male dovetails have reduced diameter portions while the female grooves similarly have corresponding reduced diameter groove portions. The male dovetails are inserted into the female dovetail grooves in an aft direction with stops of the reduced male and female dovetails preventing further movement aft. Seal welds are applied to prevent forward movement of the partitions relative to the web and outer ring.

2 Claims, 4 Drawing Sheets

MACHINE TOOLED DIAPHRAGM PARTITIONS AND NOZZLES

This application is a continuation of application Ser. No. 11/251,860, filed Oct. 18, 2005, now U.S. Pat. No. 7,329,096, the entire content of which is hereby incorporated by reference in this application.

BACKGROUND OF THE INVENTION

The present invention relates to machine tooled diaphragm partitions or nozzles for steam turbines and particularly relates to diaphragm partitions and nozzles which are readily manufactured and installed at reduced costs as original equipment manufacture or repairs.

Diaphragms for nozzle stages in steam turbines typically comprise a plurality of circumferentially spaced partitions secured at opposite ends to inner and outer spacer bands or rings. The inner and outer spacer bands are secured to an inner web and an outer ring, respectively. In original equipment manufacture, the partitions are welded into the inner and outer bands, and the bands are welded to the web and ring, respectively. The welding processes are labor intensive, require skilled artisans, are costly and time consuming. Moreover, the welding processes and the welds introduce substantial distortions into the diaphragm.

For effecting repairs, partial partition coupon segments are generally welded into place with remaining portions of the partitions. Because the base materials are high strength alloys, pre- and post-heat treating processes are necessary. This stress relief process elevates the temperature and magnifies the distortion of the steam path. When all of the thermal processes are completed, each partition is then bent and shaped mechanically to an acceptable attitude with all nozzle areas between partitions being made approximately equal. Accordingly, there is a need for a partition and diaphragm construction which will decrease the cycle time and cost of original or repaired diaphragms while improving the quality of the assembled product.

BRIEF DESCRIPTION OF THE INVENTION

In a preferred embodiment of the present invention there is provided a partition for a steam turbine comprising an airfoil; radially spaced inner and outer side walls at opposite ends of the airfoil to in part define a nozzle forming a portion of a steam path through a turbine; the side walls having generally radially projecting dovetails for engaging in generally complementary dovetail-shaped slots of a steam turbine ring and web, respectively; each dovetail including an elongated narrow section and an elongated enlarged section remote from the associated side wall with the narrow section between the associated side wall and the enlarged section.

In a further preferred embodiment of the present invention there is provided a steam turbine comprising an outer ring, an inner web, a plurality of partitions between the outer ring and inner web at circumferentially spaced locations thereabout, each partition including an airfoil and radially spaced inner and outer side walls at opposite ends of the airfoil, each of said partitions having generally radially projecting male dovetails extending from the inner and outer side walls, the web and the ring having female dovetail shaped grooves at spaced circumferential locations thereabout and generally complementary to the respective male dovetails extending from the inner and outer side walls, the male dovetails of the inner and outer side walls being received in the female dovetails of the web and ring, respectively.

DETAILED DESCRIPTION OF THE INVENTION

Figure 1:
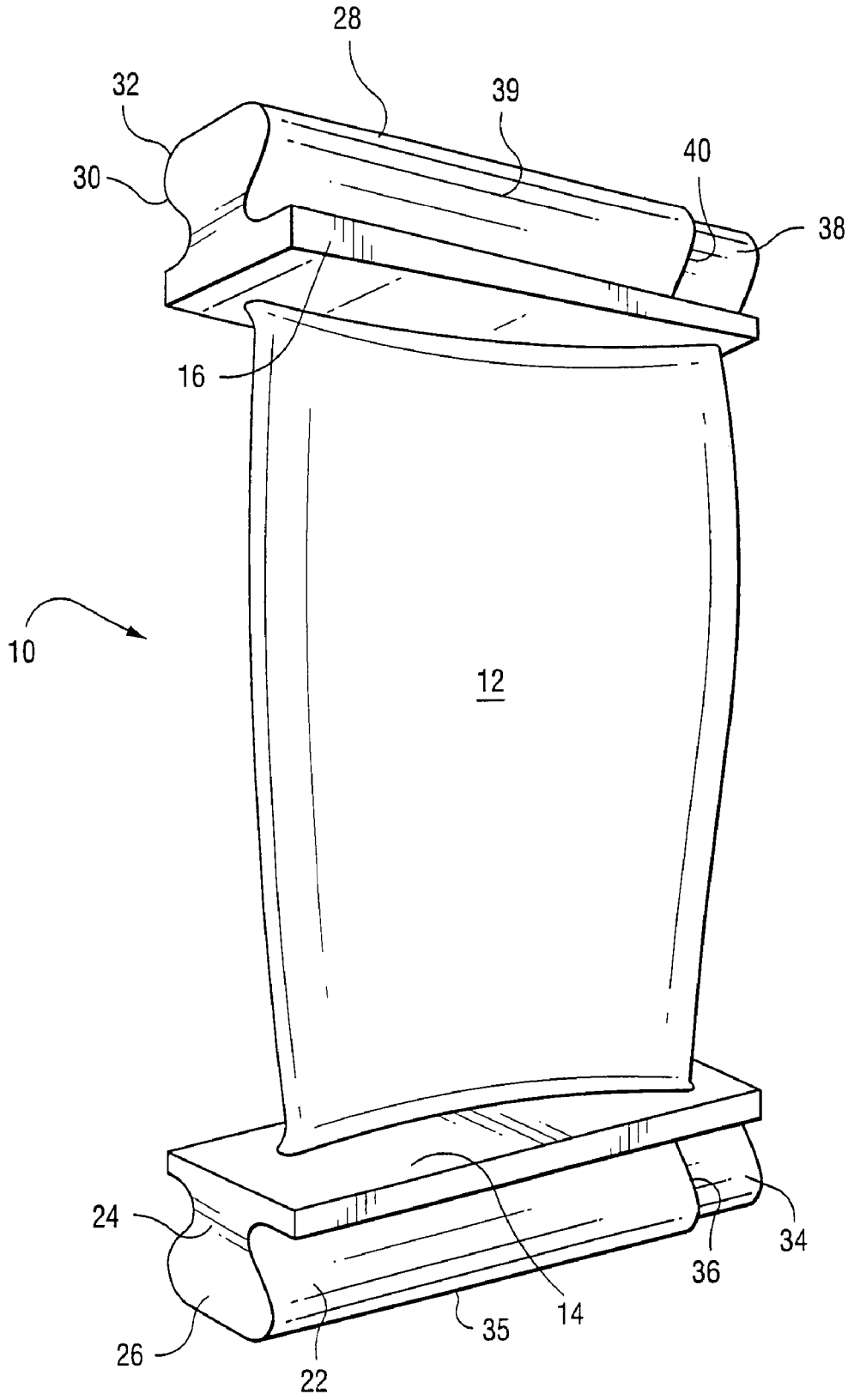
FIG. 1 is a perspective view of a partition in accordance with a preferred embodiment of the present invention.

Referring now to the drawings, particularly to FIG. 1, there is illustrated a partition generally designated 10 including an airfoil 12 having inner and outer walls 14 and 16, respectively, at opposite ends thereof. It will be appreciated, particularly from a review of FIG. 3, that the partitions 10 are disposed in an annular array thereof between an inner web 18 and an outer ring 20 and define a portion of a stage for directing steam through the nozzle areas between the partitions onto buckets of the same stage to rotate the buckets and attached rotor. Referring back to FIG. 1, male dovetails project radially from the inner and outer side walls 14 and 16, respectively. For example, a male dovetail 22 projects radially inwardly from the inner wall 14 and includes a narrow neck section 24 and a circumferentially enlarged width section 26 remote from wall 14. Similarly, the outer wall 16 includes a male dovetail 28 projecting radially outwardly and includes a narrow neck section 30 and a circumferentially enlarged width section 32 remote from wall 16. The male dovetails 22 and 28 may extend coextensively with the inner and outer walls 14 and 16, respectively. It will be appreciated that the dovetails are illustrated in a generic form and that the dovetails may comprise similar dovetail configurations including, e.g., multiple ribs and grooves. Suffice to say that the dovetails may have any cross-sectional configuration which enables the dovetails to be secured between the inner web 18 and the outer ring 20.

Figure 2:
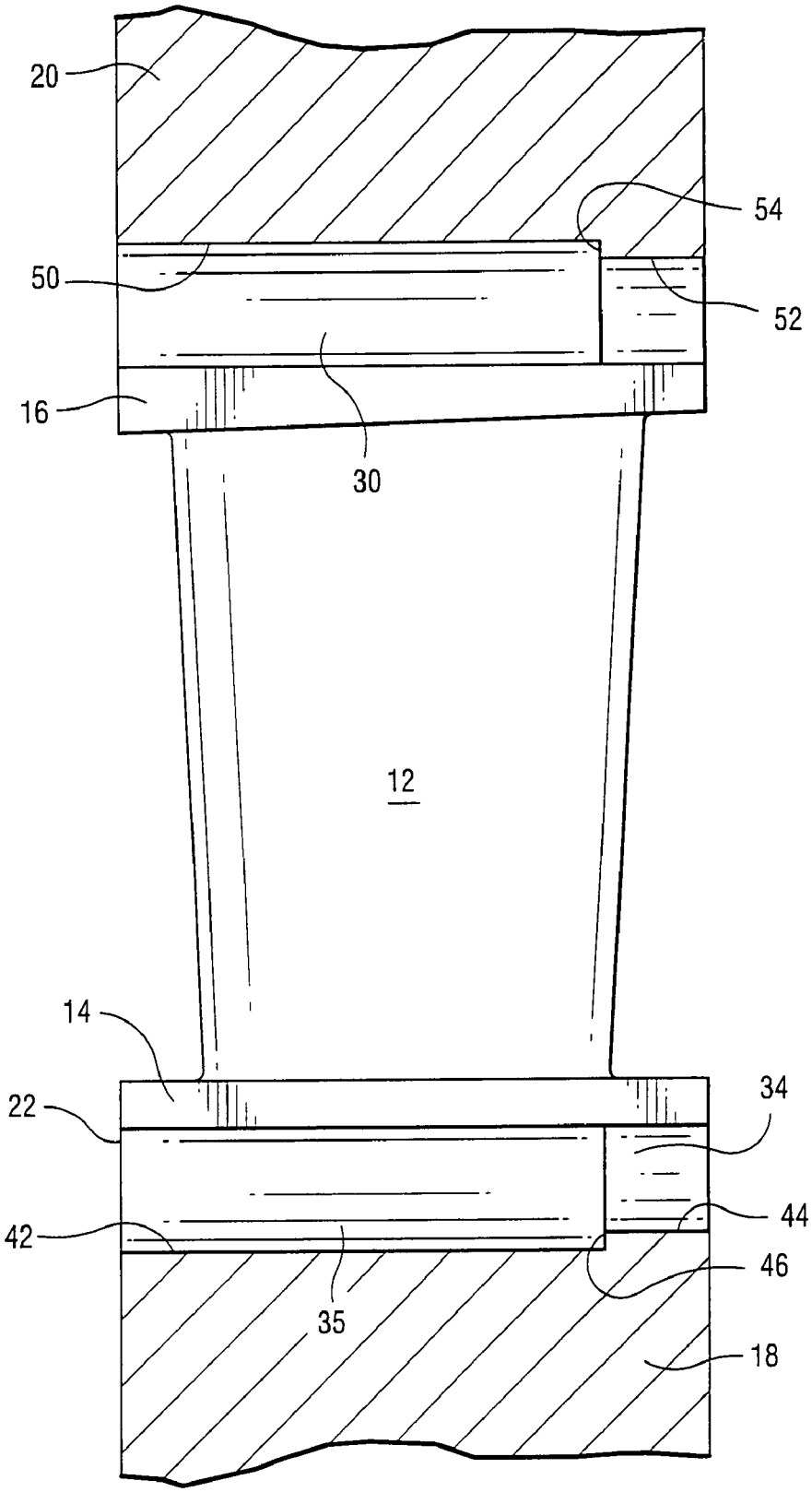
FIG. 2 is a side elevational view thereof in assembly with an inner web and outer ring.

Referring to FIGS. 1 and 2, at least one and preferably both of the male dovetails 22 and 28 have a reduced dovetail configuration at the aft end of the dovetail. Particularly, the dovetail 22 has a reduced male dovetail portion 34 which defines a stop or a shoulder 36 with the remaining portion 35 of dovetail 22. Similarly, the radially outer male dovetail 32 has a reduced dovetail portion 38 forming a stop 40 with the remaining portion 39 of dovetail 32.

Figure 3:
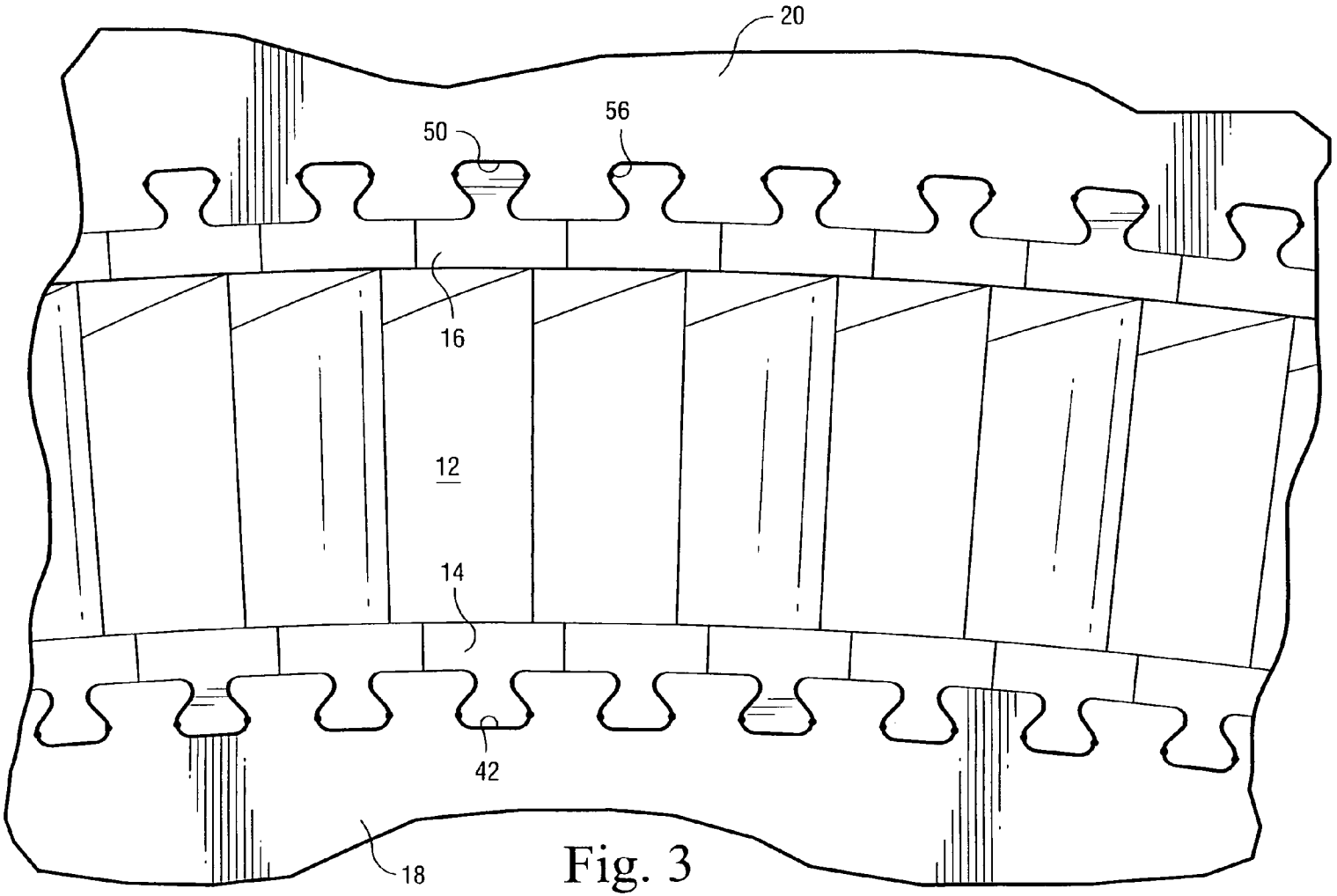
FIG. 3 is a fragmentary axial view of a portion of a diaphragm illustrating multiple partitions secured between the inner web and the outer ring.

Referring to FIGS. 2 and 3, the inner web 18 and the outer ring 20 are provided with female grooves complementary in shape to the male dovetails. For example, the inner web 18 includes a dovetail shaped groove 42 complementary to the shape of dovetail 22. The aft end of the groove 42 is reduced such that groove portion 44 is complementary in shape to the reduced male dovetail shape 34 and defines a stop 46 therewith. Similarly, the outer ring 20 includes a groove 50 complementary in shape to the male dovetail 28. The groove 50 terminates at its aft end in a reduced dovetail shape groove 52 forming a stop 54.

It will be appreciated that the partitions 10 may be cast or formed by machining to precise dimensions. With cast or machined partitions, the male dovetail portions 22 and 28 may be formed at the appropriate angle. Similarly, the female dovetail portions may be formed in the inner web and outer ring at angles corresponding to the angles of the male dovetails.

To assemble the partitions to form the diaphragm, the male dovetails of the partitions are inserted into the female dovetail grooves of the web 18 and outer ring 20. Particularly, the partitions are inserted through the forward faces of the web and inner ring in an aft direction such that stops 36 and 40 of the inner and outer male dovetails engage the stops 46 and 54, respectively, of the grooves of the web and inner ring. Consequently, the partitions are axially positioned relative to the web and outer ring. Since the steam path direction is aft, the stops preclude movement of the partitions relative to the web and outer ring in the aft direction. Welds or locking keys may be provided along forward faces of the partitions, web and inner ring to lock the partitions against movement in a forward direction. For example, welds are illustrated at 56 in FIG. 3. Consequently, the partitions and the web and outer ring are locked to one another.

Figure 4:
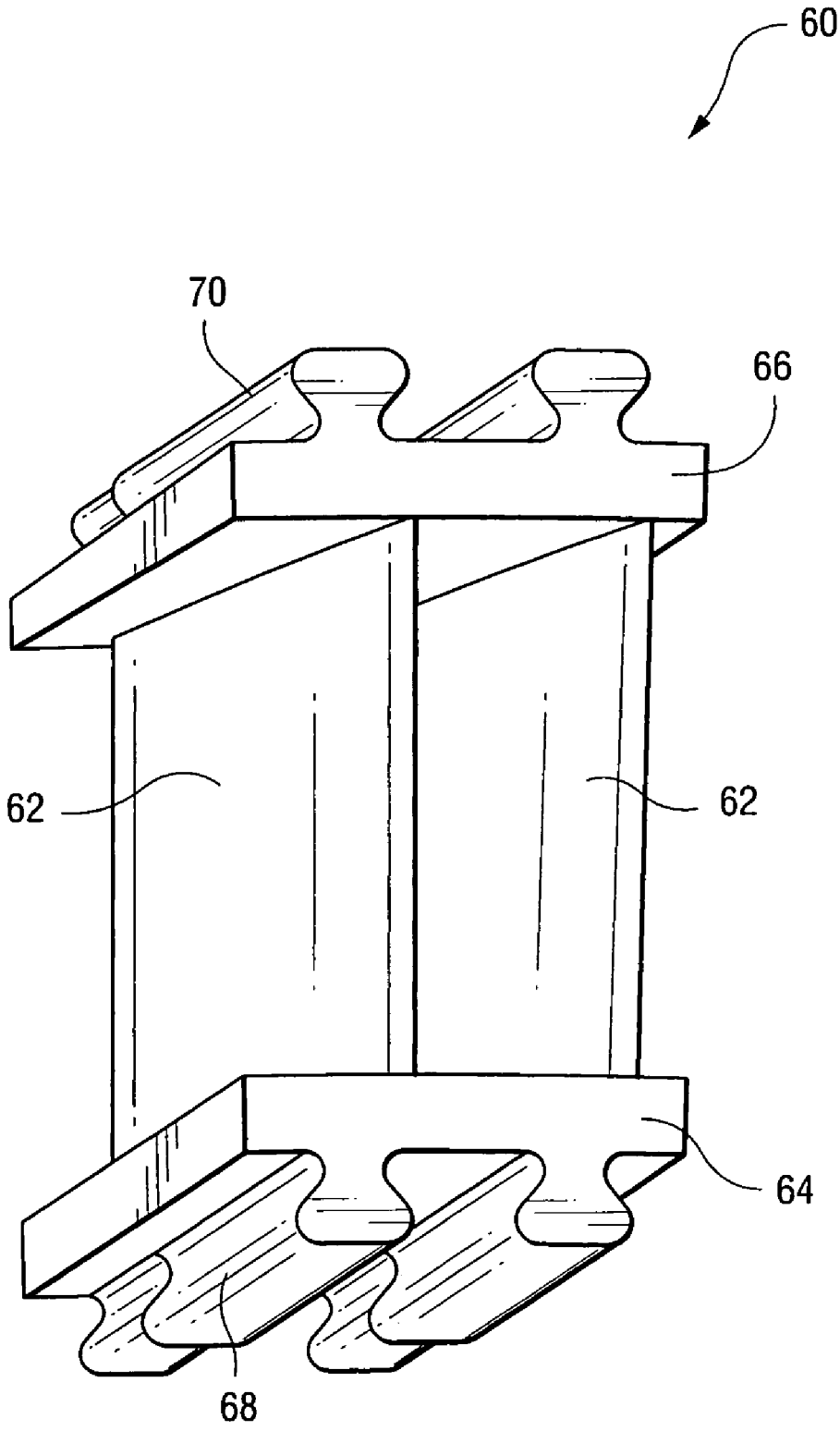
FIG. 4 is a perspective view of partitions in unitary doublet form.

Referring to FIG. 4, there is illustrated a unitary segment generally designated 60 forming a pair of side-by-side partitions with the airfoils 62 thereof secured at opposite ends to radially inner and outer side walls 64 and 66, respectively. This unitary segment includes for each of the inner and outer side walls 64 and 66 a pair of male dovetails 68 and 70, respectively. The male dovetails 68 and 70 of each segment containing the two airfoils 62 can thus be received in the female dovetails of the inner web and outer ring similarly as the partitions having only a single airfoil are received between the inner web and outer ring as previously described.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A partition for a steam turbine comprising:

an airfoil;

radially spaced inner and outer side walls at opposite ends of the airfoil to in part define a nozzle forming a portion of a steam path through a turbine;

said side walls having generally radially projecting dovetails for engaging in generally complementary dovetail-shaped slots of a steam turbine web and ring, respectively;

each said dovetail including an elongated narrow section and an elongated enlarged section remote from the associated side wall with said narrow section between said associated side wall and the enlarged section, wherein at least one of said dovetails has a reduced cross-sectional area at one end of the dovetail, forming a stop adapted to engage a corresponding stop formed in the respective complementary dovetail-shaped slot for precluding movement of the partition in a lengthwise direction of the dovetail when fully engaged in the complementary shaped slot of the turbine.

2. A partition according to claim 1 wherein said at least one of said dovetails comprises all of said dovetails.

* * * * *